US005350009A

United States Patent [19]

Mizoguchi et al.

[11] Patent Number: 5,350,009

[45] Date of Patent: Sep. 27, 1994

[54] TWIN ROLL-TYPE SHEET CONTINUOUS CASTING METHOD AND APPARATUS

[75] Inventors: Toshiaki Mizoguchi; Kiyomi Shio; Yoshiyuki Ueshima; Kazumi Yasuda; Yoshio Morimoto; Hiromitu Haga; Kenichi Miyazawa, all of Futtsu, Japan

[73] Assignee: Nippon Steel Corporation, Tokyo, Japan

[21] Appl. No.: 971,922

[22] PCT Filed: Apr. 16, 1992

[86] PCT No.: PCT/JP92/00483

§ 371 Date: Dec. 21, 1992

§ 102(e) Date: Dec. 21, 1992

[87] PCT Pub. No.: WO92/18272

PCT Pub. Date: Oct. 29, 1992

[30] Foreign Application Priority Data

Apr. 19, 1991 [JP] Japan ..... 3-088364
Jan. 24, 1992 [JP] Japan ..... 4-010625
Jan. 24, 1992 [JP] Japan ..... 4-011083

[51] Int. Cl.[5] ..... B22D 11/06; B22D 11/128; B22D 11/20

[52] U.S. Cl. ..... 164/454; 164/413; 164/417; 164/428; 164/441; 164/444; 164/477; 164/480; 164/484

[58] Field of Search ..... 164/480, 477, 428, 417, 164/483, 484, 154, 413, 454, 441, 444

[56] References Cited

U.S. PATENT DOCUMENTS 4,316,497 2/1982 Wakefield et al. ..... 164/483 X
4,644,999 2/1987 Bedell et al. ..... 164/483 X

FOREIGN PATENT DOCUMENTS 53-123304 10/1978 Japan ..... 164/480
59-165754 11/1984 Japan .
60-72647 4/1985 Japan ..... 164/480
60-177935 9/1985 Japan .
61-108452 5/1986 Japan .
63-30158 2/1988 Japan .
64-66047 3/1989 Japan ..... 164/477
1-130847 5/1989 Japan ..... 164/477
1-228650 9/1989 Japan .
2-211944 8/1990 Japan .
1581468 7/1990 U.S.S.R. ..... 164/417
1614892 12/1990 U.S.S.R. ..... 164/477
1551755 8/1979 United Kingdom .

OTHER PUBLICATIONS

Patent Abstracts of Japan, vol. 10, No. 18 (M-448) (4075) 24 Jan. 1986 & JP-A-60 177 935 (Kawasaki Seitetsu KK) 11 Sep. 1985.

Patent Abstracts of Japan, vol. 13, No. 432 (M-874) 3780) 27 Sep. 1989 & JP-A-11 66 865 (Ishikawajima Harima Heavy INd. Co. Ltd.) 30 Jun. 1989.

Patent Abstracts of Japan, vol. 12, No. 343 (M-741 (3190) 14 Sep. 1988 & JP-A-63 104 756 (Nippon Steel Corp) 10 May 1988.

*Primary Examiner*—J. Reed Batten, Jr.
*Attorney, Agent, or Firm*—Pollock, Vande Sande & Priddy

[57] ABSTRACT

A twin roll-type sheet continuous casting apparatus includes a nozzle for supplying molten metal; a pair of casting rolls for casting the molten metal supplied from the nozzle into a sheet, the casting rolls being horizontally disposed in parallel relation to each other, being cooled, and rotated in opposite directions, respectively; a coiler; and a support sheet extending generally horizontally below the pair of casting rolls for receiving the cast sheet and transferring it to the coiler, and being taken up by the coiler along with the cast sheet placed therein. Since tension is not applied to the cast sheet, even a brittle material can be continuously cast into a sheet. Also, a dummy sheet requested for starting the casting of the sheet becomes unnecessary, and even when a rupture of the sheet occurs, the apparatus can be continuously operated without stopping the operation.

15 Claims, 5 Drawing Sheets

TWIN ROLL-TYPE SHEET CONTINUOUS CASTING METHOD AND APPARATUS

TECHNICAL FIELD

This invention relates to twin roll-type sheet continuous casting method and apparatus, and more particularly to twin roll-type sheet continuous casting method and apparatus suited for casting a sheet of a brittle material such as Fe-Cu alloy.

BACKGROUND OF THE INVENTION

In a twin roll-type sheet continuous casting apparatus, a pair of cooled casting rolls disposed horizontally and parallel to each other are rotated in opposite directions, respectively, and molten metal is continuously supplied between the pair of rotating casting rolls to continuously cast a sheet, and the cast sheet is extended to a coiler through a group of pinch rollers and transfer rollers, and is continuously taken up by the coiler.

Usually, in the above apparatus, a dummy sheet is used when starting the casting of the sheet. The dummy sheet is beforehand joined to a leading end portion of the cast sheet, and a leading end portion of this dummy sheet is wound around the coiler through the group of pinch rollers and transfer rollers. When the casting of the sheet is started, the dummy sheet is taken up by the coiler to guide the leading end portion of the cast sheet so that it can be taken up by the coiler.

When the cast sheet is ruptured, the operation of the apparatus is stopped, and the dummy sheet is again joined to the leading end portion of the cast sheet as described above. Then, the operation is resumed.

Twin roll-type sheet continuous casting apparatuses which do not need the use of a dummy sheet are proposed in Japanese Patent Unexamined Publication No. 60-177935 and Japanese Utility Model Unexamined Publication No. 59-165754, respectively.

The former apparatus includes a device for supplying two strip-like sheets which device is disposed below a pair of casting rolls. When the casting of a sheet is started, the two strip-like sheets are placed on a group of transfer rolls, and leading end portions thereof are wound around a coiler. A leading end portion of a sheet cast by the casting rolls is sandwiched between the two strip-like sheets, and is taken up, together with the strip-like sheets, by the coiler. After the leading end portion of the cast sheet is taken up by the coiler, the supply of the strip-like sheets is stopped, and only the cast sheet is taken up by the coiler. Namely, in this apparatus, since the leading end portion of the cast sheet is guided to the coiler by the two strip-like sheets, the dummy sheet is not needed. However, when a rupture of the cast sheet occurs, the operation of the apparatus must be stopped in order to set the strip-like sheets.

The latter apparatus includes a water passage in which a fluid flows at a speed higher than the speed of transfer of a cast sheet, this water passage serving as a transfer device for transferring the cast sheet to a coiler. When the casting of the sheet is started, the leading end portion of the cast sheet is transferred to the coiler by the fluid, and is taken up by the coiler. Then, the cast sheet is continuously taken up by the coiler. Since the leading end portion of the cast sheet is guided to the coiler by the fluid, the dummy sheet is not needed. Further, even if a rupture of the cast sheet occurs, the leading end portion of the cast sheet is again transferred to the coiler by the fluid, and therefore the operation of the apparatus does not need to be stopped.

These apparatuses are both suited for the continuous casting of a sheet of a ductile material such as stainless steel, and are not suited for the casting of a sheet of a brittle material such as Fe-Cu alloy. The reason for this is that when the cast sheet is to be wound on the coil, tension is applied to the cast sheet. In the case of the ductile material, the cast sheet is hardly ruptured by this tension. However, in the case of the brittle material, the sheet is ruptured immediately when the tension is applied thereto.

Up to now, any twin roll-type sheet continuous casting apparatus capable of continuously casting a sheet of a brittle material has not been proposed.

Summary of the Invention

It is therefore an object of this invention to provide twin roll-type sheet continuous casting method and apparatus which are capable of continuously casting a sheet of a brittle material, which do not need a dummy sheet required for starting the casting of the sheet, and can continue the operation of the apparatus without stopping the operation even if a rupture of the sheet occurs.

A twin roll-type sheet continuous casting method according to the present invention comprises the steps of continuously casting molten metal, supplied from a nozzle, into a sheet by a pair of horizontally-disposed casting rolls; placing the cast sheet on a support sheet extending below the pair of casting rolls; and taking up the support sheet, having the cast sheet placed thereon, by a coiler.

A twin roll-type sheet continuous casting apparatus according to the present invention comprises a nozzle for supplying molten metal; a pair of casting rolls for casting the molten metal, supplied from the nozzle, into a sheet, the casting rolls being horizontally disposed in parallel relation to each other, and cooled, and being rotated in opposite directions, respectively; a coiler; and a support sheet extending generally horizontally below the pair of casting rolls, and being taken up by the coiler.

The twin roll-type sheet continuous casting apparatus according to the present invention further comprises displacement detection means for detecting a displacement of a curved portion produced when the cast sheet is to be placed on the support sheet; and control means for effecting a feedback control of the speed of take-up of the support sheet by the coiler in accordance with detection results provided by the displacement detection means in such a manner that the speed of take-up of the support sheet by the coiler can be brought into agreement with the casting speed.

The support sheet may be curved toward the pair of casting rolls at a position below the casting rolls.

Instead of curving the support sheet, a curved guide member may be provided between the support sheet and the casting rolls.

The support sheet may be a perforated sheet, and cooling means may be provided in a path of transfer of the cast sheet.

A support sheet take-up reel for taking up the support sheet from the coiler may be further provided.

If the displacement detection means is contact-type detection means, a detection element of the detection means is disposed on a concave surface side of the curved portion of the cast sheet. If the curved guide member is provided, a gap for allowing the cast sheet to pass therethrough is maintained between the detection element and the guide surface of the curved guide member when the detection element is disposed at a lower dead center.

According to the present invention, the cast sheet is taken up without being subjected to tension. Therefore, the sheet of a brittle material can be continuously cast. And besides, a dummy sheet required for starting the casting of the sheet becomes unnecessary, and even when a rupture of the sheet occurs, the apparatus can be continuously operated without stopping the operation.

BEST MODE FOR CARRYING OUT THE INVENTION

Figure 1:
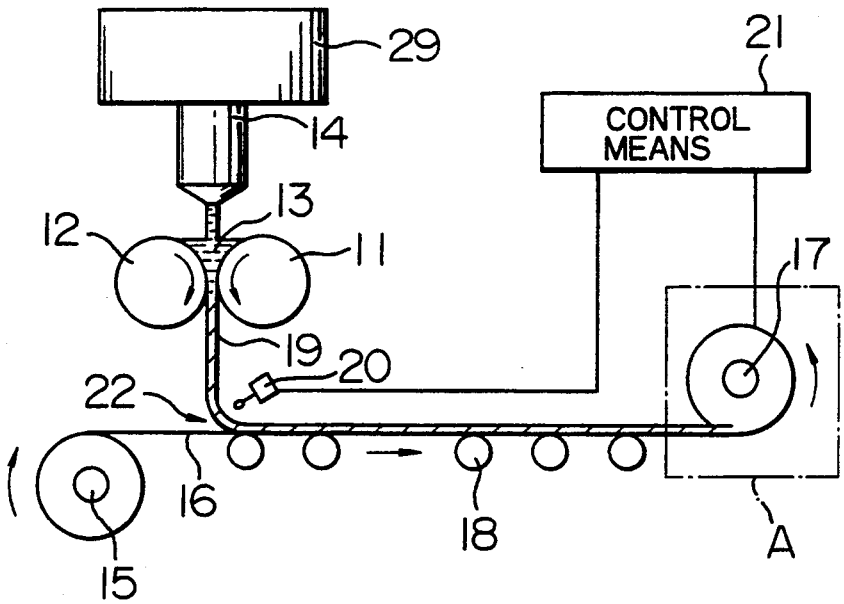
FIG. 1 is a schematic view of a first embodiment of a twin roll-type sheet continuous casting apparatus of the present invention.
Figure 2:
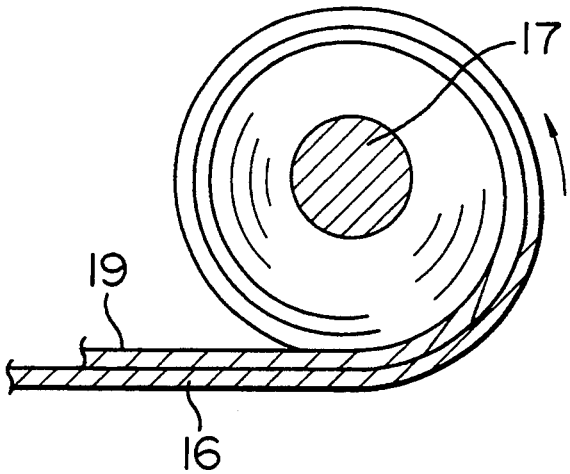
FIG. 2 is an enlarged view of a portion A of FIG. 1.

A twin roll-type sheet continuous casting apparatus according to the present invention will now be described with reference to FIGS. 1 and 2.

The twin roll-type sheet continuous casting apparatus comprises a pair of casting rolls 11, 12. These casting rolls 11, 12 are horizontally disposed in closely spaced, parallel relation to each other. Cooling water flows through the interior of each of the casting rolls 11, 12, and the outer surface of each roll has been subjected to a fire-resistant treatment. A molten metal reservoir 13 is formed on the upper side of the pair of casting rolls 11, 12, and a tundish 29 for holding molten metal and a nozzle 14 for continuously supplying the molten metal from the tundish 29 to the molten metal reservoir 13 are provided above the molten metal reservoir 13.

A support sheet supply reel 15 is provided below the pair of casting rolls 11, 12, and a support sheet 16 is supported by a group of support rolls 18, and is extended from the support sheet supply reel 15 to lie generally horizontally below the casting rolls, and is taken up by a coiler 17. Although the kind of the support sheet is not limited, a sheet of soft steel or stainless steel is preferred.

A displacement detector 20 for detecting a displacement of a sheet 19 is provided in the vicinity of a curved portion 22 produced when the sheet 19 cast by the casting rolls 11, 12 is to be placed on the support sheet 16. The displacement detector 20 detects the position of the curved portion 22 of the cast sheet 19, and outputs a voltage value corresponding to the detection value. For example, when the curved portion 22 approaches the detector 20, the detector outputs a small voltage value, and when the curved portion moves away from the detector, it outputs a large voltage value. Further, there is provided a control device 21 for effecting a feedback control of the speed of take-up of the support sheet by the coiler 17 in accordance with the detection results from the displacement detector 20. A standard voltage value $V_M$ corresponding to the standard transfer speed of the cast sheet 19, as well as a lower limit voltage value $V_L$ corresponding to the lower limit transfer speed, are stored in the control device 21.

The casting rolls 11, 12 are rotated in opposite directions, respectively, as illustrated, and the molten metal of a brittle material such as, for example, Fe-Cu alloy is continuously supplied to the molten metal reservoir 13. As a result, solidified shells are formed respectively on the surfaces of the casting rolls 11, 12, and are integrally joined together at nip portions of the pair of casting rolls 11, 12 to form the cast sheet 19 which is continuously discharged vertically downwardly from the lower side of the casting rolls.

The cast sheet 19 thus discharged is placed on the support sheet 16 extended generally horizontally below the casting rolls. The support sheet 16 is taken up by the coiler 17 activated simultaneously with the activation of the casting rolls, and therefore the cast sheet 19 placed on the support sheet 16 is transferred toward the coiler in the condition in which the cast sheet is kept placed on the support sheet 16. As shown in FIG. 2, the coiler 17 takes up the support sheet 16 in such a manner that the cast sheet 19 is wound internally of the support sheet 16. At this time, the tension due to the take-up is applied to the support sheet 16, but tension is not applied to the cast sheet 19 placed on the support sheet 16.

On the other hand, in order that tension will not be applied to the cast sheet 19 during the transfer of the cast sheet 19, it is necessary to bring the casting speed of the cast sheet 19 generally into agreement with the transfer speed of the support sheet, that is, the take-up speed of the coiler 17. Next, this control will now be described with reference to FIG. 3.

Figure 3:
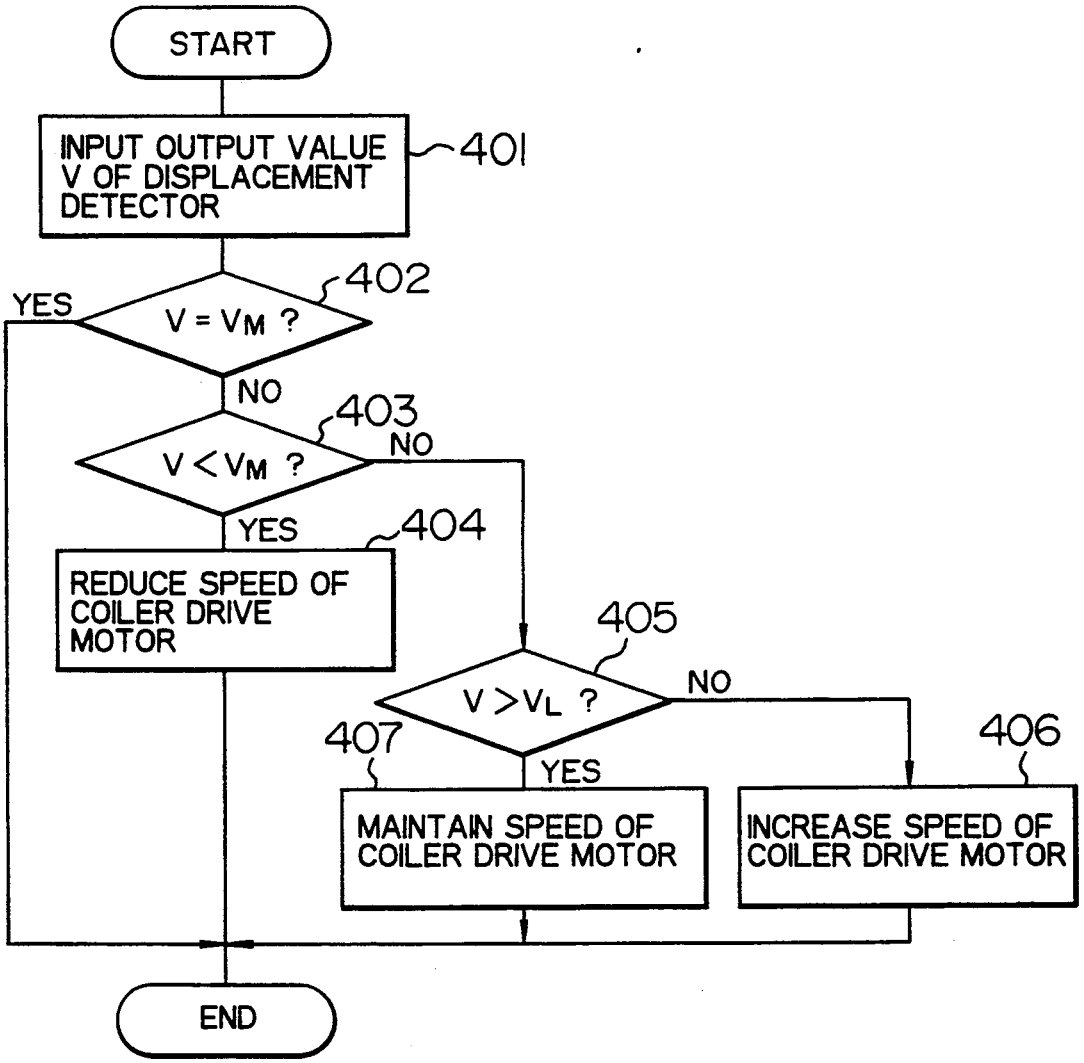
FIG. 3 is a flow chart of a feedback control of a coiler take-up speed in the twin roll-type sheet continuous casting apparatus of the present invention.

A feedback control routine shown in FIG. 3 is an interrupt routine executed, for example, at intervals of 4 msec, and its execution is started by turning on a power switch of the coiler 17. The control device 21 inputs an output voltage value V of the displacement detector 20 thereinto, and compares it with the prestored standard voltage value $V_M$ corresponding to the standard transfer speed (Steps 401 and 402). If the output voltage value V of the displacement detector 20 is equal to the standard voltage value $V_M$, that is, if the transfer speed of the cast sheet is generally equal to the casting speed, the present take-up speed of the coiler 17 is maintained, and the feedback control routine is repeated.

If the output voltage value V is smaller than the standard voltage value $V_M$, that is, if the transfer speed of the cast sheet is higher than the casting speed, the take-up speed of the coiler 17 is reduced (Steps 403 and 404).

If the output voltage value V is larger than the standard voltage value $V_M$, that is, if the transfer speed of the cast sheet is lower than the casting speed, it is compared with the lower limit voltage value $V_L$ (Step 405). If the output voltage value V is smaller than the lower limit voltage value $V_L$, the take-up speed of the coiler 17 is increased (Step 406). If the output voltage value V is larger than the lower limit voltage value $V_L$ (which means that a rupture develops in the cast sheet 19, so that the cast sheet to be measured is not present before the displacement detector 20), the take-up speed of the coiler 17 is maintained at this speed (Step 407). This procedure is for the purpose of preventing the take-up speed of the coiler from becoming excessive.

By repeating the above control at intervals of 4 msec, the feedback control can be effected so that the take-up speed of the coiler can be brought into agreement with the casting speed of the cast sheet, and tension is not applied to the cast sheet 19, and a brittle material can be cast into a sheet.

Furthermore, if a rupture develops in the cast sheet, the subsequent cast sheet is placed on the support sheet, and is transferred by the support sheet, and therefore the operation of the casting apparatus can be continued without stopping the operation.

Other embodiments of twin roll-type sheet continuous casting apparatuses of the present invention will be described below, and only those portions thereof different from the first embodiment will be described.

Figure 4:
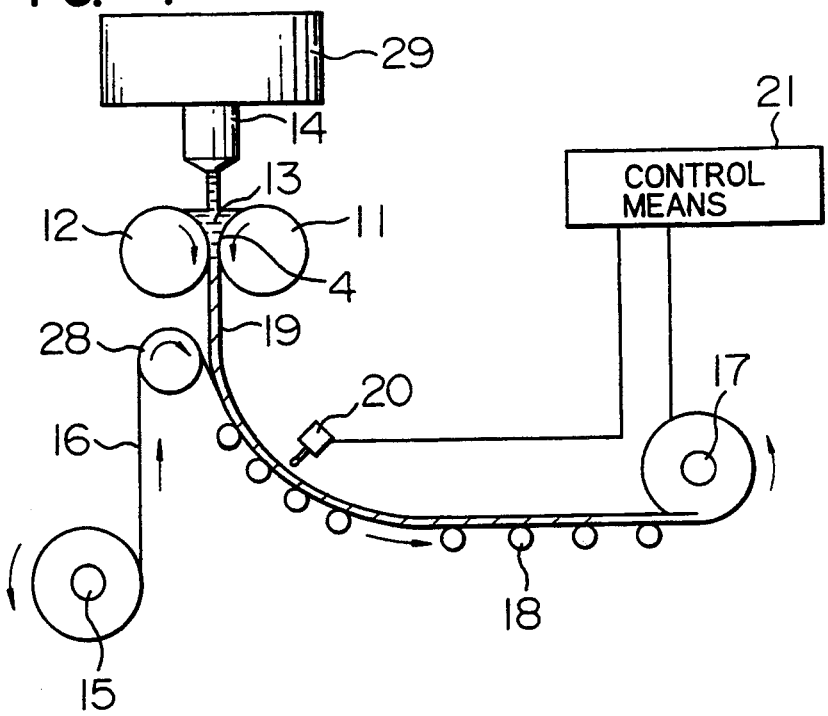
FIG. 4 is a schematic view of a second embodiment of a twin roll-type sheet continuous casting apparatus of the present invention.

A second embodiment of a twin roll-type sheet continuous casting apparatus of the present invention will now be described with reference to FIG. 4. When a brittle material is cast into a sheet, a cast sheet 19 may be ruptured by the weight of its depending portion before disposed on a support sheet 16. In this case, it would be desirable for the whole of the mechanism of the first embodiment related to the support sheet to be disposed closer to the casting rolls, however, this may not always be possible because of a limited space. The second embodiment is effective for such a case. In the second embodiment, the support sheet 16 is curved toward casting rolls 11, 12 by a turning roll 28 at a position below the casting rolls. With this construction, a cast sheet 9 is rapidly placed on the support sheet 16, and the generation of tension due to the weight of the depending portion can be restrained.

Figure 5:
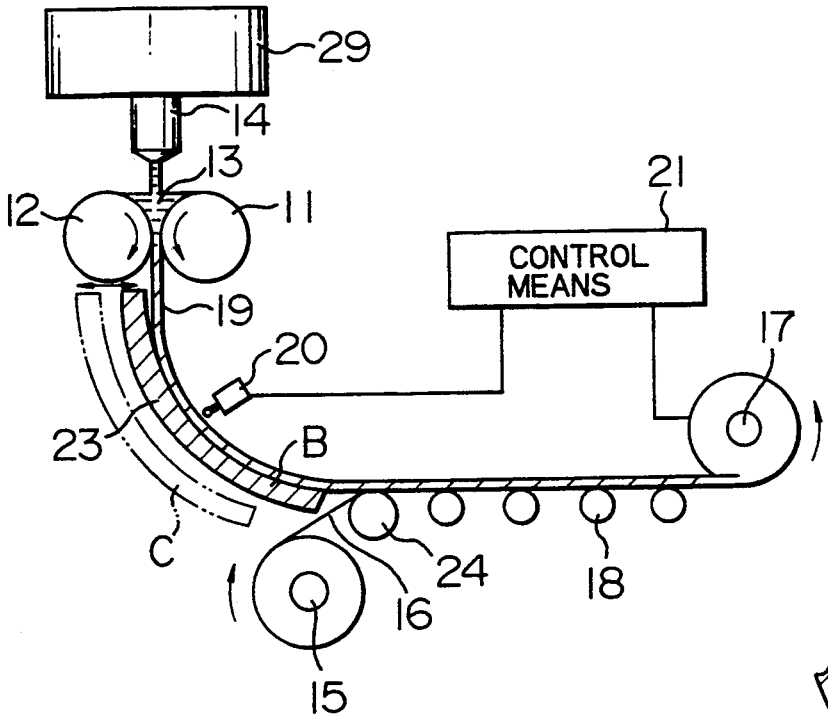
FIG. 5 is a schematic view of a third embodiment of a twin roll-type sheet continuous casting apparatus of the present invention.

Next, a third embodiment of a twin roll-type sheet continuous casting apparatus of the present invention will now be described with reference to FIG. 5. Instead of curving the support sheet in the second embodiment, a curved guide member 23 for guiding a cast sheet 19 from a position beneath nip portions of casting rolls 11, 12 onto a support sheet 16 is provided below the casting rolls 11, 12. The curved guide member 23 is movable between an initial position B where the curved guide member is disposed at the time of the start of the casting and an operation position C spaced apart from the cast sheet 19. Thanks to a turning roll 24, the support sheet 16 is extended generally horizontally from a position near an outlet of the curved guide member 23 to a coiler 17.

At the time of the start of the casting, the curved guide member 23 guides the leading end portion of the cast sheet 19, depending from the nip portions of the casting rolls 11, 12, to the support sheet 16 extending generally horizontally below the casting rolls. After the leading end portion of the cast sheet 19 is placed on the support sheet 16, the curved guide member 23 is moved to the operation position C. Using the position, at which the cast sheet 19 is disposed when the curved guide member 23 is disposed at the initial position B, as the position corresponding to the above-mentioned standard transfer speed, the speed of take-up of the support sheet by the coiler 17 is controlled in accordance with the above-mentioned feedback control routine.

If using the position, at which the cast sheet 19 slightly floats off the guide surface of the curved guide member 23 disposed at the initial position B, as the position corresponding to the standard transfer speed, the speed of take-up of the support sheet by the coiler 17 is controlled in accordance with the abovementioned feedback control routine, the curved guide member 23 may be stopped at the initial position B.

Figure 6:
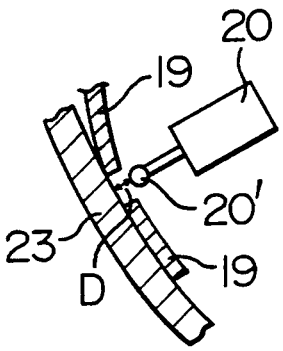
FIG. 6 is a fragmentary, enlarged view showing a rupture of a cast sheet in the third embodiment in which a contact-type displacement detector is used as a displacement detector.

As shown in FIG. 6, when the curved guide member 23 and a contact-type displacement detector serving as the displacement detector are used, it is important that the contact-type displacement detector 20 be disposed on the concave surface side of the curved guide member 23, and that a gap D for allowing the cast sheet 19 to pass therethrough be provided between the guide surface of the curved guide member 23 and the lower dead center (the position where a detection element 20' of the contact-type displacement detector is projected fully toward the curved guide member) of the contact-type displacement detector 20. Referring to this reason, when the cast sheet 19 is ruptured, the detection element 20' of the contact-type displacement detector 20 is projected to the lower dead center, and without the above gap D, the distal end of the ruptured portion of the sheet 19 would strike against the detection element 20', so that the sheet 19 could not reach the support sheet 16.

Figure 7:
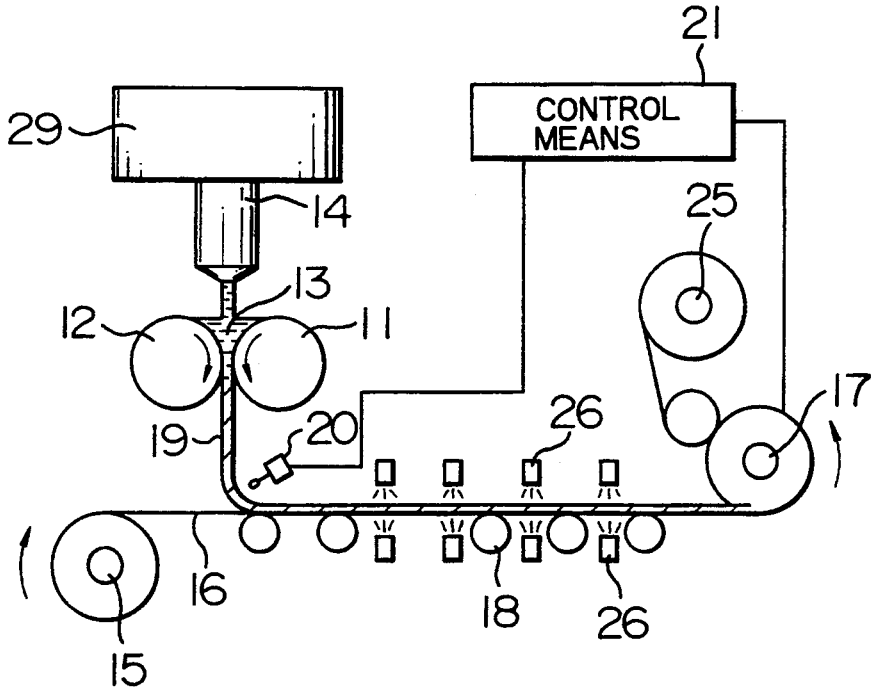
FIG. 7 is a schematic view of a fourth embodiment of a twin roll-type sheet continuous casting apparatus of the present invention.

Next, a fourth embodiment of a twin roll-type sheet continuous casting apparatus of the present invention will be described with reference to FIGS. 7 and 8.

Figure 8:
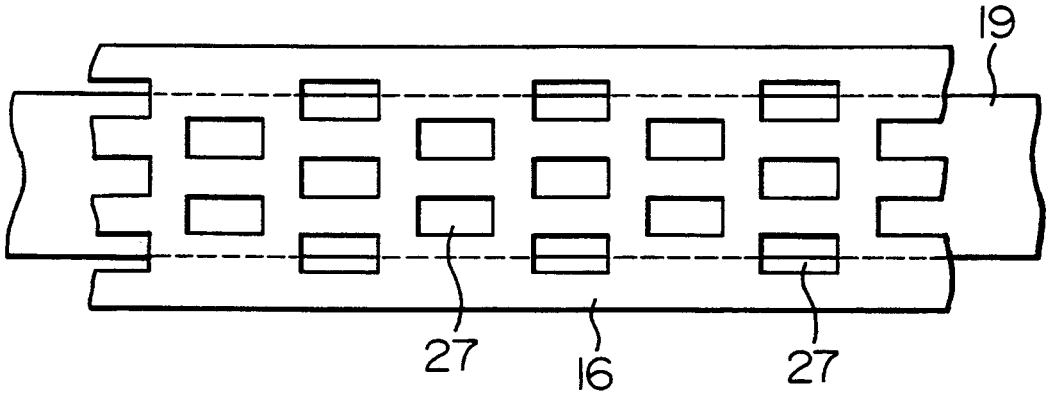
FIG. 8 is a plan view of a perforated support sheet used in the fourth embodiment.

In the fourth embodiment, a plurality of through holes 27 are formed through a support sheet, as shown in FIG. 8. The support sheet 16 is fed from a support sheet supply reel 15, and is extended generally horizontally below casting rolls, and is taken up by a support sheet take-up reel 25 via a coiler 17. A plurality of cooling medium ejection nozzles 26 are provided on upper and lower sides of a path of transfer of the support sheet 16 and a cast sheet 19.

When the cast sheet 19 is placed on the support sheet 16, and is transferred along the transfer path, the cooling medium ejection nozzles eject a cooling medium to the cast sheet. The support sheet 16 is a perforated sheet, and therefore the cooling medium, ejected from the cooling medium ejection nozzles 26 provided on the lower side of the transfer path, passes through the through holes 27, and is brought into direct contact with the cast sheet 19 to sufficiently cool the cast sheet 19.

On the other hand, after the support sheet 16 winds the cast sheet 19 around the coiler 17, the support sheet is taken up from the coiler 17 by the support sheet take-up reel 25. The winding of the cast sheet around the coiler is effected by the tension of the support sheet, and therefore tension is not applied to the cast sheet, and there is no risk of a rupture. According to this embodiment, the cast sheet can be sufficiently cooled in the transfer path, and besides only the cast sheet can be wound into a coil shape. The perforated sheet may be replaced by a mesh sheet.

Figure 9:
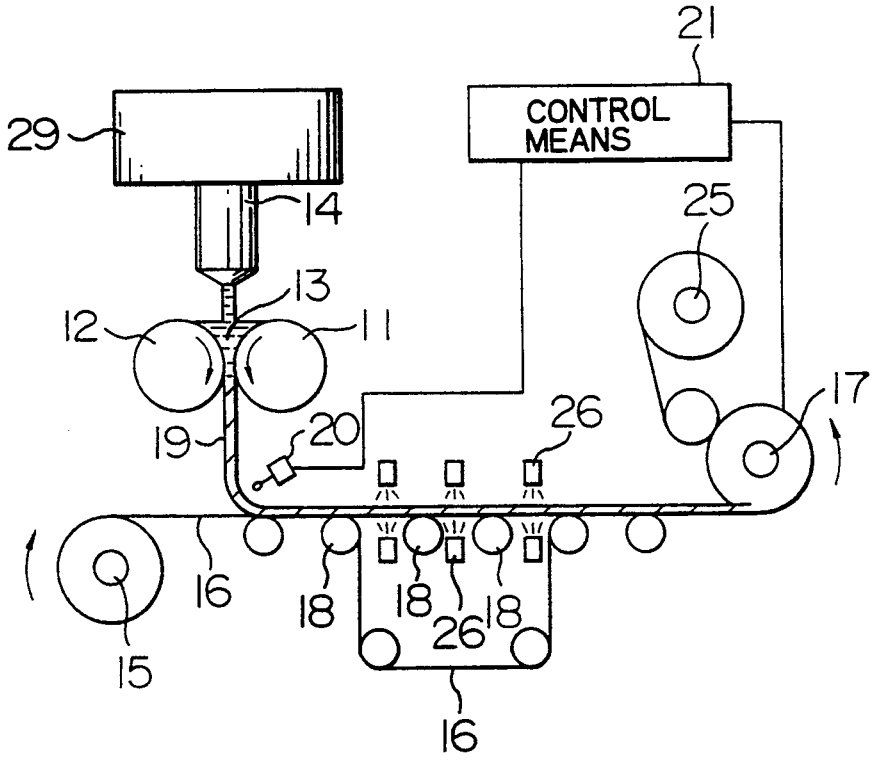
FIG. 9 is a schematic view of a modified form of the fourth embodiment of the twin roll-type sheet continuous casting apparatus of the present invention.

FIG. 9 shows a modified form of the fourth embodiment. A by-pass for passing only the support sheet 16 is provided at the transfer path of the support sheet 16 and the cast sheet 19. The cast sheet 19 is supported by a group of support rollers 18, and is transferred toward the coiler 17, and the support sheet 16 is taken up by the coiler 17 via the by-pass. A plurality of cooling medium ejection nozzles 26 are provided at the transfer path of the cast sheet 19 where the support sheet is by-passed.

In this modified example, since the support sheet 16 is by-passed, the efficiency of the cooling from the lower side of the cast sheet 19 can be enhanced. Further, the support sheet may not be a perforated sheet.

We claim:

1. A twin roll-type sheet continuous casting method comprising the steps of:

continuously casting molten metal, supplied from a nozzle, into a sheet by a pair of horizontally-disposed casting rolls;

placing said sheet discharged from said casting rolls on a support sheet extending below said pair of casting rolls;

continuously transferring said cast sheet on said support sheet towards a coiler; and taking up said support sheet, having said cast sheet placed thereon, by said coiler.

2. A method according to claim 1, wherein said support sheet is being taken up by said coiler such that said cast sheet is wound internally of said support sheet.

3. A method according to claim 2 further comprising the steps of:

detecting a displacement of a curved portion produced when said cast sheet is to be placed on said support sheet; and controlling the speed of take-up of said support sheet by said coiler based on said detected displacement to bring the speed of take-up into agreement with the casting speed.

4. A twin roll-type sheet continuous casting apparatus comprising:

a nozzle for supplying molten metal;

a pair of casting rolls for casting said molten metal, supplied from said nozzle, into a sheet, said casting rolls being horizontally disposed in parallel relation to each other, and being cooled, and being rotated in opposite directions, respectively;

a coiler; and a movable support sheet extending substantially horizontally below said pair of casting rolls, said support sheet being positioned for receiving said cast sheet discharging from said casting rolls and for continuously transferring said cast sheet towards said coiler, said support sheet with said cast sheet placed thereon being taken up by said coiler.

5. A twin roll-type sheet continuous casting apparatus according to claim 4, further comprising:

displacement detecting means for detecting a displacement of a curved portion produced when said cast sheet is to be placed on said support sheet; and control means for effecting a feedback control of the speed of take-up of said support sheet by said coiler based on detection results from said displacement detection means in such a manner that the speed of take-up of said support sheet by said coiler is brought into agreement with the casting speed.

6. A twin roll-type sheet continuous casting apparatus according to claim 4 wherein said support sheet is curved toward said pair of casting rolls at a position below said casting rolls.

7. A twin roll-type sheet continuous casting apparatus according to claim 5 wherein said support sheet is curved toward said pair of casting rolls at a position below said casting rolls.

8. A twin roll-type sheet continuous casting apparatus according to claim 4 wherein a curved guide member is provided between said support sheet and said casting rolls.

9. A twin roll-type sheet continuous casting apparatus according to claim 5 wherein a curved guide member is provided between said support sheet and said casting rolls.

10. A twin roll-type sheet continuous casting apparatus according to claim 4 wherein said support sheet is a perforated sheet having a plurality of through holes, and wherein cooling means is provided in a path of transfer of said cast sheet.

11. A twin roll-type sheet continuous casting apparatus according to claim 5 wherein said support sheet is a perforated sheet having a plurality of through holes, and wherein cooling means is provided in a path of transfer of said cast sheet.

12. A twin roll-type sheet continuous casting apparatus according to claim 4 wherein a by-pass is provided at a path of transfer of said support sheet, and wherein a cooling device is provided at that portion of the transfer path of said cast sheet corresponding to said by-pass.

13. A twin roll-type sheet continuous casting apparatus according to claim 5 wherein a by-pass is provided at a path of transfer of said support sheet, and wherein a cooling device is provided at that portion of the transfer path of said cast sheet corresponding to said by-pass.

14. A twin roll-type sheet continuous casting apparatus according to claim 4 wherein a support sheet take-up reel is provided for taking up said support sheet from said coiler.

15. A twin roll-type sheet continuous casting apparatus according to claim 9 wherein said displacement detection means is contact-type detection means, and is disposed on a concave surface side of said curved portion of said cast sheet; and wherein when a detection element of said displacement detection means is disposed at a lower dead center, a gap for allowing said cast sheet to pass therethrough is maintained between said detection element and a guide surface of said curved guide member.

* * * * *